United States Patent [19]

Unterberger

[11] Patent Number: 4,865,320

[45] Date of Patent: Sep. 12, 1989

[54] BOWLING PIN BASE

[76] Inventor: Werner Unterberger, Emiliano Zapata 12, Naucalpan, Edo. de Mexico, Mexico

[21] Appl. No.: 165,933

[22] Filed: Mar. 9, 1988

[51] Int. Cl.[4] ..... A63B 9/00

[52] U.S. Cl. ..... 273/182 B

[58] Field of Search ..... 273/82 R, 82 B

[56] References Cited

U.S. PATENT DOCUMENTS

| | | | |
|---|---|---|---|
| 3,186,713 | 6/1965 | Hebble | 273/82 B |
| 3,477,721 | 11/1969 | Satchell et al. | 273/82 B |
| 3,525,524 | 8/1970 | Schmid | 273/82 B |
| 3,971,837 | 7/1976 | Hasegawa et al. | 273/82 R |
| 4,322,078 | 3/1982 | Mallette | 273/82 B |
| 4,630,820 | 12/1986 | Bertozzi | 273/82 B |

*Primary Examiner*—Edward M. Coven
*Assistant Examiner*—Gary Jackson
*Attorney, Agent, or Firm*—Klaus D. Thoma

[57] ABSTRACT

Exterior radial or tangential openings are cut or molded within a bowling pin base insert which permit the exterior plastic coat during the injection molding process to flow into such openings and, upon hardening, form a tight and rotationally secure locking arrangement between the base insert, the exterior plastic coat and the wooden pin core, said bowling pin base insert having an interior annular recess to provide expansion space for the bowling pin wood core.

14 Claims, 1 Drawing Sheet

BOWLING PIN BASE

FIELD OF THE INVENTION

Figure 1:
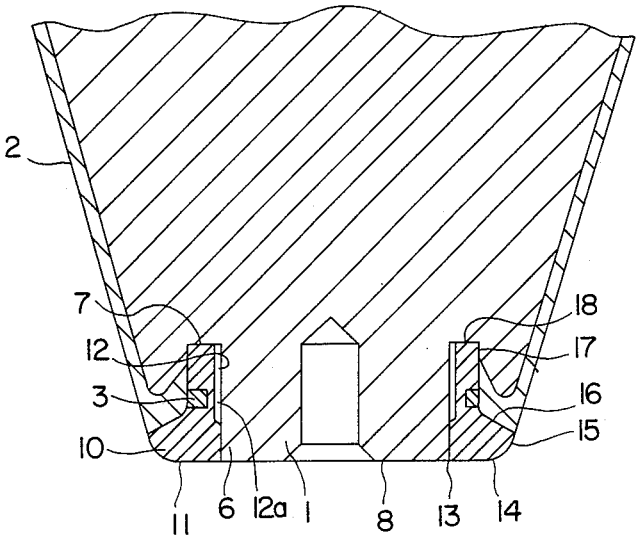

The present invention relates to bowling pins, and more particularly, to an improved bowling pin base.

PRIOR ART

Modern day bowling pins generally consist of a wooden core with a plastic coating for impact protection and durability. The plastic cover, in turn, is reinforced at the base by a separate plastic ring. This ring protects a high impact area of the pin and is generally designed to prevent cracking of the wooden core or the plastic covering in that particular area. It is well known in the art to design a nylon or other plastic base for bowling pins in the form of an insert connected to the bottom of the wooden core by forming an undercut in a groove in the wood and then heating one end of the insert to cause the plastic to flow into the undercut to lock the two parts together. This has the inherent disadvantage of being mechanically a cumbersome application and one which is difficult to monitor from a quality control point of view. In addition, the use of two parts fused together represents a point prone to later separation in an area where mechanical reinforcement is most needed.

Improvements upon this method of securing reinforcement rings to the wood core consist in methods locking the reinforcement ring into the encapsulating plastic cover instead of the wood. In U.S. Pat. No. 4,332,078 issued to Mallette for example, a locking groove is shown in the nylon ring itself, rather than in the wood core, as disclosed by earlier prior art. Mallette's nylon ring is generally "L" shaped along its outer perimeter and is inserted into the annular opening of the wood core at the bottom of the pin prior to applying the plastic coating to the pin. The step of locking the base ring to the plastic coating is thus incorporated into the process of molding of the plastic cover around the entire pin. Instead of heating the ring to the point where it flows into undercuts in the wood core, and thus locking the ring to the wood, Mallette secures the ring within a locking lip formed by the plastic coating of the pin. During the molding process, the heated coating material will flow into an undercut within the base ring and harden there into an annular retention lip around the perimeter of the base ring.

This method of securing the base ring between the wooden core and the outer coating still has two inherent weaknesses. On the one hand, the geometrical shape of the ring is non-uniform and still contains stress points at the neck of the "L" shaped groove, which can lead to fractures in this high impact zone. Secondly, the step of securing the ring to the outer plastic shell is carried out during the molding process, i.e. at the time when a great temperature differential exists between the cold nylon base ring and the hot outer coating. Upon cooling, some clearance is likely to develop between the ring, the coating and the wooden core. Under the impact of the bowling action, it is possible for the ring to free itself to the point of being able to rotate within the space between the locking lip and the wooden core. This, in turn, results in an unsteady base and can permit the intrusion of water into the wooden core when the pins are washed and cleaned.

Lastly, a common problem of prior art bowling pin base rings is the tight shrink fit between the ring and the wood core. Bowling pins are routinely washed in water or some cleansing solution. During such cleansing the liquid will penetrate into the wood core, causing the water-soaked wood to swell up and expand locally to such extent, that frequently the base ring and the lower part of the outer plastic shell break and crack, eventually leading to failure of the entire pin.

The instant invention has overcome all of these disadvantages of the prior art. A plastic base ring, which does not have to be heated itself, is locked to the outer plastic coating during the one-step process of encapsulating the wooden pin with its outer plastic cover in such a manner that it is secured in place both against vertical and rotational movement while at the same time providing expansion space for the wooden core if necessary. Briefly, as compared to the prior art, a geometrically simpler and stronger ring with an inner annular expansion space provided within its upper portion is encapsulated in the plastic coating during the injection molding process, which takes place at great pressures, and, through radial and/or tangential openings within the base ring, the ring is locked directly onto the outer nylon coating, thus forming a tighter lock and preventing later rotation.

Figure 2:
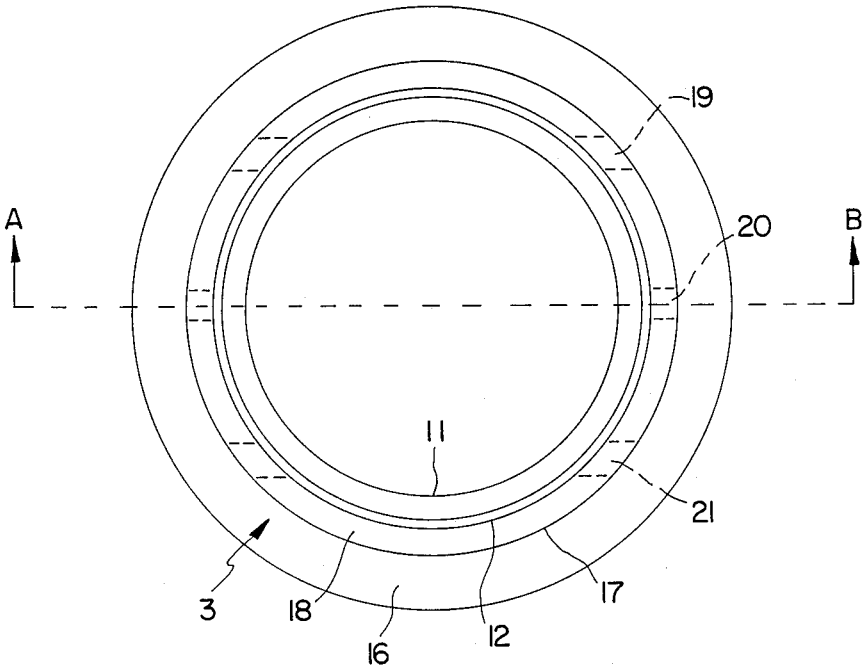

The invention will best be understood by reference to the following detailed description taken in connection with the accompanying sheet of drawing, in which FIG. 1 is a sectional view of the locking mechanism of the present invention; and FIG. 2 is a top view of the base ring the present invention.

Referring particularly now to FIG. 1, shown therein is the bottom portion of the pin. The pin comprises a wood core 1, with its encapsulating outer plastic coating 2, and plastic base ring 3 preferably made out of nylon. Wood core 1 is provided within its lower end portion with a generally flat, horizontal shoulder 7, leading up to a cylindrical end section 6, which in turn terminates at the flat bottom surface 8 upon which the entire pin rests. Cylindrical end section 6 and transition shoulder 7 are geometrically simple and smooth and are therefore easy and inexpensive to manufacture, and do not require undercuts or a narrow peripherally extending core flange (as shown by Mallett) which represents a stress concentration point for the bowling impact forces.

The outer annular support surface for the bowling pin adjacent to the bottom surface 8 of the wood core is provided by the plastic base insert generally depicted in FIG. 1 as base insert 3. Base insert 3 is a plastic ring with a radially enlarged bottom portion 10 which, along its outer perimeter, provides a smooth transitional surface between the terminus of outer plastic coating 2 and the pin support surface 8 of wood core 1. Base ring 3 has a smooth inner annular surface 11 which abuts exterior cylindrical surface 6 of wood core 1 when base ring 3 is slipped over the cylindrical bottom portion of wood core 1 prior to the injection molding process for forming plastic coating 2 around the entire pin. Inner annular surface 11 recedes in its upper portion to a larger diameter annular end surface 12, thus creating a recess space **12*a* between base 3 and cylindrical surface 6 of wood core 1. Upper annular surface 12 in turn ends in a chamfered transitional surface, which becomes horizontal top surface 18. When ring 3 is slipped onto cylindrical surface 6 of wood core 1, horizontal wood shoulder 7 provides the resting place for top surface annulus 18** of base ring 3. Recess space 12*a* provides the expansion room needed for wood core 1 to expand and "work" if liquid penetrates the lower portion of the pin's wood core, thus minimizing the risk of expansion fractures in base ring and pin coating.

The outer cylindrical surface 17 of base ring 3 is parallel to inner surfaces 11 and 12 and between the define a cylindrical locking ring which in the preferred embodiment of the present invention is approximately 4 mm radial thickness between outer surface 17 and interior recess surface 12. In the lower portion 10 of base ring 3, its inner radial diameter is enlarged so that ring inner surface 12 and wood core end section 6 abut tightly, while the outer radial thickness of base ring 3 within this lower portion 10 is enlarged along downwardly sloped incline portion 16. In the preferred embodiment of the present invention, the downward slope of incline 16 forms an angle of approximately 15 degrees with the horizontal plane a defined by bottom surface 8. Inclined shoulder 16 extends downwardly to a radial thickness approximately twice the thickness of the cylindrical portion defined by surfaces 11 and 17, and ends precisely where its outer radius coincides with the exterior cross-section radius of outer shell 2 at that point.

Radially downtapering transitional surface 15 of bottom portion 10 of base ring 3 extends the smooth outer contours of plastic cover 2 of the pin downwardly to radial contour section 14. Radial section 14 provides the transition surface between upwardly sloped surface 15 and horizontal base surface 13, which in turn is flush with bottom surface 8 of wood core 1.

Within base 3, a plurality of generally circular openings, e.g., channels 19, 20, 21, 22, 23 and 24 as shown in FIG. 2, are provided within the upper cylindrical locking portion of base ring 3 as defined between surfaces 12 and 17 of ring 3. Circular channels 19–24 shown to the right do not extend all the way through ring 3 but terminate approximately one-half millimeter exteriorly of inner annular surface 12, but provide openings into outer annular surface 17, sufficient to permit outer coating 2 in its fluid state to penetrate into these openings and, upon hardening, to form radial locking fingers within cylindrical holes 19–24. In the preferred embodiments of the present invention, circular openings 19–24 are pre-formed within the mold for forming base ring 3, but they may also be cut or drilled into ring 3 mechanically. During the injection molding process of pin coating 2 around wood core 1, the hot plastic fluid which turns into outer coating 2 after cooling, is able to flow under the pressure of the injection molding process through openings 19-24 into base ring 3, and to directly form a locking connection between outer coating 2 and base ring 3. Upon hardening of plastic coating 2, a much improved, tighter lock is thus ensured between wood core 1, base ring 3 and outer coating 2, both in a vertical, horizontal and radial plane, virtually eliminating the problem of later separation, rotation and fluid seepage. If water or cleansing fluid does seep in and cause expansion of the lower portion of wood core 1, the annular expansion space 12*a* between wood surface 6 and ring surface 12 will permit the wood to expand without causing excessive stress on either base ring 3 or outer coating 2.

I claim:

1. A plastic base ring for supporting a plastic coated bowling pin comprising a lower annular portion, an upper annular portion having an outer radial diameter smaller than the outer radial diameter of said lower annular portion, and at least one non annular opening within said outer radial surface of said upper annular portion.

2. A plastic base ring for supporting a plastic coated bowling pin comprising a lower annular portion, an upper annular portion having an outer radial diameter smaller than the radial diameter of said lower annular portion and an inner radial diameter larger than the inner radial diameter of said lower annular portion, and at least one nonannular opening within said outer radial surface of said upper annular portion which is filled by said plastic coating when it is applied, in its fluid state, to fill the space between said upper annular portion and said lower annular portion.

3. In a bowling pin comprising a wood core having an exposed flat bottom surface, an exterior plastic cladding on said wood core, and a plastic base ring inserted between said exterior plastic cladding and said wood core at the bottom of said core, said plastic base insert having at least one nonannular opening therein into which said exterior plastic cladding may flow while said plastic cladding is in a fluid state.

4. The bowling pin of claim 3 wherein said plastic base insert is comprised of an upper portion of generally hollow cylindrical shape having at least one opening within its outer cylindrical walls and a lower portion of larger radial diameter than its upper portion, said lower portion being co-terminus at one end with said exposed flat bottom surface of said wood core and providing at its other end the lower terminal shoulder for said exterior plastic cladding.

5. The bowling pin of claim 4 wherein said exterior plastic cladding in its heated state fills the space defined by said opening within said upper portion of said plastic base insert, thus rigidly connecting together, upon cooling of said plastic cladding, said wood core at one end of said opening, and thus rigidly connecting said plastic base insert and said exterior plastic cladding.

6. The bowling pin of claim 5 wherein said opening comprises at least one circular nonannular channel extending into said upper portion of said plastic base insert.

7. In a bowling pin comprising a wood core having an exposed flat bottom surface, an exterior plastic cladding on said wood core, and a plastic base ring inserted between said exterior plastic cladding and said wood core at the bottom of said core, said plastic base insert having an inside diameter throughout its upper portion larger than the outside diameter of said bottom portion of said wood core, defining an annular expansion space between said wood core and said base ring.

8. The bowling pin of claim 7 wherein said plastic base insert is comprised of an upper portion of generally hollow cylindrical shape having at least one opening within its outer cylindrical walls and a lower portion of larger radial diameter than its upper portion, said lower portion being co-terminus at one end with said exposed flat bottom surface of said wood core and providing at its other end the lower terminal shoulder for said exterior plastic cladding.

9. The bowling pin of claim 8 wherein said exterior plastic cladding in its heated state fills the space defined by said opening within said upper portion of said plastic base insert, thus rigidly connecting together, upon cooling of said plastic cladding, said wood core at one end of said opening, and thus rigidly connecting said plastic base insert and said exterior plastic cladding.

10. The bowling pin of claim 9 wherein said opening comprises at least one circular nonannular channel extending into said upper portion of said plastic base insert.

11. The bowling pin of claim 14 wherein said opening comprises at least one circular channel extending into said upper portion of said plastic base insert.

12. In a bowling pin comprising a wood core having an exposed flat bottom surface, an exterior plastic cladding on said wood core, and a plastic base ring inserted between said exterior plastic cladding and said wood core at the bottom of said core, said plastic base insert having an inside diameter throughout its upper portion larger than the outside diameter of said bottom portion of said wood core, defining an annular expansion space between said wood core and said base ring and having at least one opening within said upper portion of said plastic base insert into which said exterior cladding may flow while said plastic cladding is in a fluid state.

13. The bowling pin of claim 12 wherein said plastic base insert is comprised of an upper portion of generally hollow cylindrical shape having at least one opening within its outer cylindrical walls and a lower portion of larger radial diameter than its upper portion, said lower portion being co-terminus at on end with said exposed flat bottom surface of said wood core and providing at its other end the lower terminal shoulder for said exterior plastic cladding.

14. The bowling pin of claim 13 wherein said exterior plastic cladding in its heated state fills the space defined by said opening within said upper portion of said plastic base insert, thus rigidly connecting together, upon cooling of said plastic cladding, said wood core at one end of said opening, and thus rigidly connecting said plastic base insert and said exterior plastic cladding.

* * * * *